United States Patent [19]

Lee et al.

[11] Patent Number: 4,983,878

[45] Date of Patent: Jan. 8, 1991

[54] FIELD INDUCED EMISSION DEVICES AND METHOD OF FORMING SAME

[75] Inventors: Rosemary A. Lee, Northwood, England; Nandasiri Samarakone, Kessello, Belgium; Neil A. Cade, Rickmansworth, England

[73] Assignee: The General Electric Company, p.l.c., England

[21] Appl. No.: 235,471

[22] Filed: Aug. 24, 1988

[30] Foreign Application Priority Data

Sep. 4, 1987 [GB] United Kingdom ..... 8720792

[51] Int. Cl.[5] ..... H01J 1/30; H01J 1/46; H01J 9/14

[52] U.S. Cl. ..... 313/308; 313/309; 313/336; 313/351; 445/35; 445/46; 445/58; 156/632; 156/648; 427/126.1

[58] Field of Search ..... 313/309, 336, 351, 308; 445/35, 11, 12, 46, 58; 156/632, 644, 648, 649; 427/126.1

[56] References Cited

U.S. PATENT DOCUMENTS

| | | | |
|---|---|---|---|
| 3,665,241 | 5/1972 | Spindt et al. | 313/351 |
| 3,755,704 | 8/1973 | Spindt et al. | 313/336 X |
| 4,008,412 | 2/1977 | Yuito et al. | 313/336 X |
| 4,578,614 | 3/1986 | Gray et al. | 313/309 |
| 4,721,885 | 1/1988 | Brodie | 313/309 X |

FOREIGN PATENT DOCUMENTS

| | | |
|---|---|---|
| 0172089 | 2/1986 | European Pat. Off. . |
| 0234989 | 9/1987 | European Pat. Off. . |
| 53-121454 | 10/1978 | Japan . |
| 1143995 | 2/1969 | United Kingdom . |
| 1336729 | 11/1973 | United Kingdom . |
| 1473850 | 5/1977 | United Kingdom . |
| 1498232 | 1/1978 | United Kingdom . |
| 1530841 | 11/1978 | United Kingdom . |
| 2067007 | 7/1981 | United Kingdom . |

*Primary Examiner*—Kenneth Wieder

*Attorney, Agent, or Firm*—Kirschstein, Ottinger, Israel & Schiffmiller

[57] ABSTRACT

In a method of forming a field-induced emission device, a cathode is provided on a substrate, for example by etching away the substrate to leave a pointed projection. The projection may be covered with a metallic layer to enhance the field-induced cathode emission. A first insulating layer is formed over the substrate, with an aperture therein corresponding to the cathode position. An apertured control grid layer is formed over the first insulating layer and an apertured second insulating layer is formed thereon. A tunnel formed by the apertures in the insulating and conductive layers is filled with a plug of soluble material. An anode strip is formed on the second insulating layer and over the plug, and the plug is then dissolved through gaps at the edges of the anode strip, thereby leaving an unsupported area of anode strip over the cathode. The tunnel may then be evacuated or may be filled with gas and the gaps at the edges of the anode strip will then be sealed to retain the vacuum or gas. If a diode structure is required, the control grid layer and the second insulating layer will be omitted. A switching device may be constructed by associating a number of the cathodes on the substrate with a common control grid and a common anode. The anode, grid and cathode structures may be so dimensioned as to form a transmission line.

19 Claims, 7 Drawing Sheets

FIELD INDUCED EMISSION DEVICES AND METHOD OF FORMING SAME

BACKGROUND OF THE INVENTION

1. Field of the Invention

This invention relates to vacuum and gas-filled valve devices in which electrons are emitted from a cold cathode by virtue of a field emission process.

2. Description of Related Art

Over the past thirty years, semiconductor device technology has replaced vacuum valve technology for all but the most specialized electronic applications. There are many reasons for the preference for semiconductor devices. For example, they have a higher operating speed than vacuum devices, they are more reliable, they are considerably smaller and they are cheaper to produce. Furthermore, their power dissipation is much lower, particularly when compared with thermionic vacuum devices which require a considerable amount of cathode heating power.

However, it has become apparent that at least in one respect vacuum valve devices are greatly superior to devices based on solid state materials. The vacuum devices are far less affected by exposure to extreme or hostile conditions, such as high and low temperatures. Because the band gaps of useful semiconductors are necessarily of the order of lev and many other interband excitations are lower than this, excitation of intrinsic carriers occurs at temperatures only slightly above room temperature. This severely modifies the characteristics and the performance of semiconductor devices. In addition, the electron occupancy of the traps and other defect states which determine the properties of semiconductor structures is extremely temperature sensitive. The problems become increasingly acute with the trend towards smaller semiconductor devices and higher integration density.

Vacuum devices, on the other hand, suffer to a much smaller extent from such problems. The density of the conduction electrons which are responsible for thermionic and field emission processes is not dependent on temperature, and because the devices have barriers with large work functions, thermal activation requires a temperature of at least 1000° K. Furthermore, it is now recognized that the most important of the previously-accepted advantages of semiconductor devices, namely their integrability and their cheapness of manufacture, derive largely from the small size of the devices rather than from their solid state nature. Hence, if vacuum devices were made in a micron size range, such devices could be insensitive to environment, whilst being as small and fast as current semiconductor devices. Indeed, it is possible that such vacuum devices could be made to operate even faster than semiconductor devices, since the ultimate speed of the electrons in vacuo would be the speed of light, whereas that in a semiconductor device is limited to a considerably lower value by scattering or by phonon emission.

Although some recent work has been done on thermionic devices, it is likely that field emission devices will prove more successful, because the field emission effect is less dependent upon temperature.

We have previously proposed a method of forming a vacuum device in which cathode, grid and anode structures are formed on a substrate, such that the structures are coplanar and the electron flow is substantially parallel to the substrate. The fabrication of such a device is simple to achieve, but the device suffers from the disadvantage that the electron path is long, which may result in a loss of operational efficiency in the device. Furthermore, large-scale integration of such devices is limited, because only a relatively low packing density can be achieved due to the flat electrode configuration.

SUMMARY OF THE INVENTION

It is an object of the present invention to provide an improved field-induced emission device which allows a higher packing density.

According to one aspect of the invention there is provided a method of forming a field-induced emission device, comprising forming a cathode body on a substrate; forming thereover an electrically-insulating layer having an aperture therein through which the cathode body is revealed; filling the aperture with a plug of soluble material; forming a strip of electrically-conductive material on the insulating layer and extending across the plug; and dissolving the plug from beneath the conductive strip to leave a portion of the strip suspended across the aperture and spaced from the cathode body, to act as an anode.

An electrically-conductive layer may be disposed between the substrate and the conductive strip, the conductive layer being provided with an aperture therethrough, the apertures in the conductive and insulating layers being substantially coaxial, whereby the edge of the conductive layer around its aperture acts as a control electrode.

According to another aspect of the invention there is provided a field-induced emission device, comprising a substrate; a cathode body formed on the substrate; an electrically-insulating layer deposited over the substrate and having an aperture therethrough through which the cathode body is revealed; and a strip of electrically-conductive material supported by the insulating layer and extending across the aperture and spaced from the cathode body, to act as an anode; wherein the cathode body is structured for field-induced electron emission therefrom at an anode/cathode voltage less than will cause breakdown of the insulating layer.

Due to the small size of individual devices which can be achieved by the invention, a large number of the devices, for example $10^6$ or $10^8$ devices, may be fabricated on a single 10 cm diameter silicon wafer. Large-scale integration may therefore be achieved with directly, resistively or capacitively coupled arrays of devices.

BRIEF DESCRIPTION OF THE DRAWINGS

Embodiments of the invention will now be described, by way of example, with reference to the accompanying drawings, in which:

Referring to FIGS. 1 and 2, a first operation in a method of manufacturing a field-induced emission device comprises forming a cathode body of pyramid shape projecting from a silicon substrate. The pointed shape of the cathode body is conducive to field-induced emission from the cathode. The cathode body is formed by firstly growing a thin silicon dioxide layer on a substrate 1, masking a rectangular pad area, and etching away the unmasked parts of the silicon dioxide layer to leave a rectangular pad 2 of silicon dioxide immediately over the desired position for the cathode body. This pad acts as a mask for subsequent wet etching of the silicon substrate, using a conventional crystallographic etch. By this process a tapered, generally pyramid-shaped body 3 is left projecting from the remaining part 4 of the substrate. The pad 2 is then removed in hydrofluoric acid.

Figure 1:
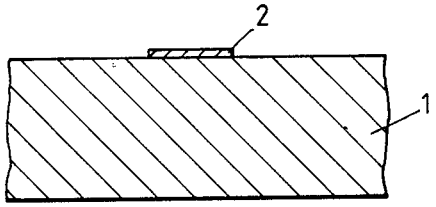
FIGS. 1–12 show schematic cross sections through a device in accordance with the invention, at respective stages in the manufacture of the device.
Figure 2:
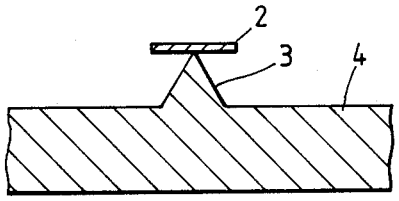
Figure 3:
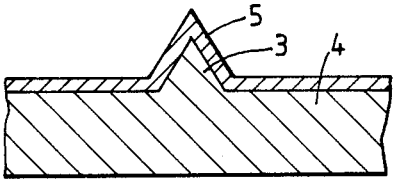
Figure 13:
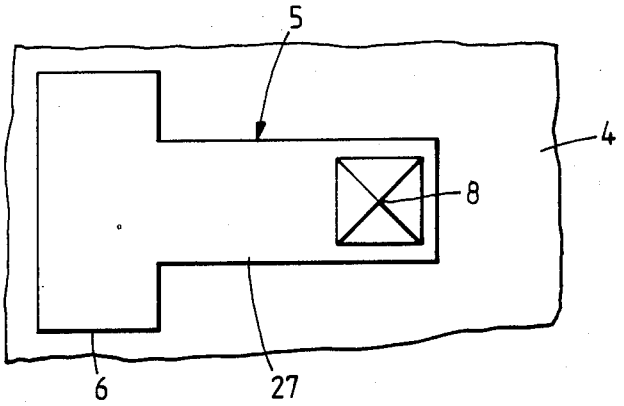
FIG. 13 is a schematic plan view of a cathode metallization layer.

Although the silicon may itself be suitable for use as a cathode, it may be preferable to coat the silicon with a thin layer 5 (FIG. 3) of a metal, such as refractory tungsten or molybdenum or a composite layer comprising a plurality of metal layers. The metal or composite layer 5 is deposited over the cathode body 3, the layer being shaped, by masking after deposition, followed by etching to remove the unmasked areas to leave a bond pad region 6 (FIG. 13) connected to the cathode body 3 by a strip 27. Alternatively, the layer 5 may be so structured by masking before depositon followed by removal of surplus metal with the mask. The metal cathode coating 5 enhances the field-induced electron emission of the cathode body, protects it from contamination and provides a more mechanically stable emission surface. The bond pad region 6 provides low resistance means by which an electrical bias potential can be applied to the cathode.

Figure 4:
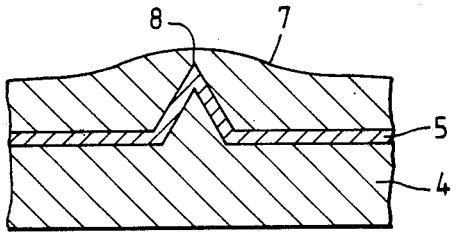

A layer 7 of insulating dielectric (FIG. 4) is next deposited over the metallization 5 by a chemical vapour deposition process. The layer preferably comprises an undoped layer of borophospho silicate glass (BPSG) of, say, 0.2–0.5 μm thickness, covered by a 1–2 μm layer of doped BPSG. Such a layer is initially non-planar, but a degree of surface smoothing is achieved by heating the device in a furnace at 900° C. to 950° C. in a steam atmosphere. Alternatively, or additionally, planarization may be achieved by applying supplementary planarizing coatings, such as a resist or spin-on glass material, and by using a controlled etch back technique. Provided that the rate of etching of the planarizing coating matches that of the underlying BPSG layer, a planarized surface will result. During the etching process, particularly if the cathode body has not been metallized, it must be ensured that the tip 8 of the cathode is not exposed to the etchant, as this could remove the sharp point at the tip and thereby degrade the emission characteristic of the cathode.

Figure 5:
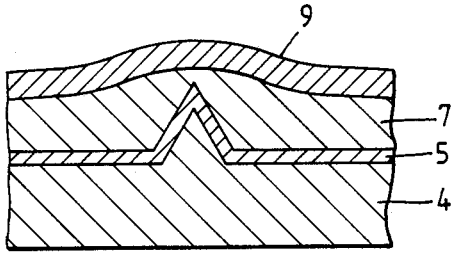
Figure 6:
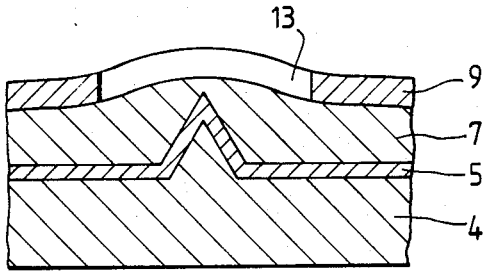
Figure 7:
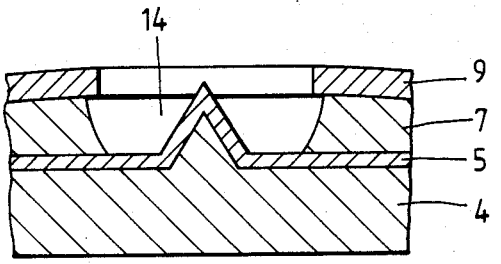
Figure 14:
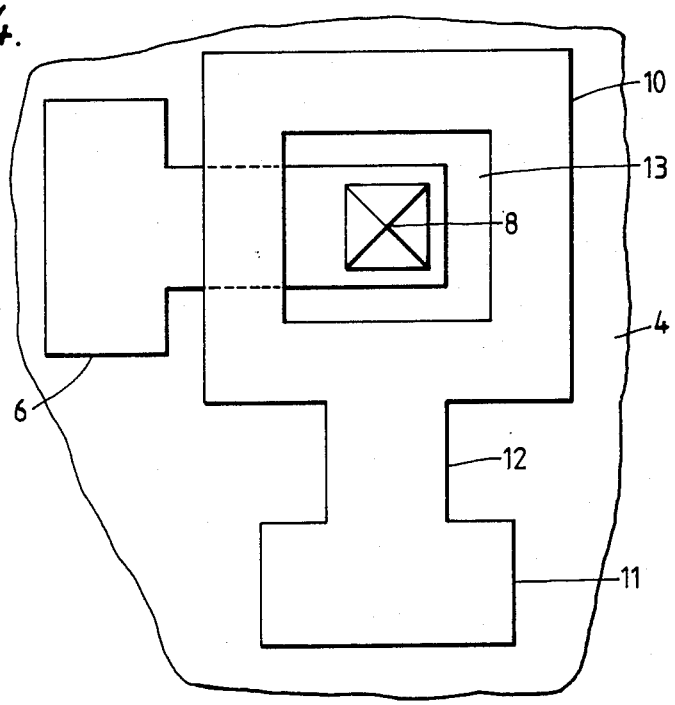
FIGS. 14 and 15 are schematic plan views of the device before and after deposition of an anode layer.

A control grid lying in the same plane as the tip of the cathode body is next formed. A polysilicon layer 9 (FIG. 5) is deposited over the BPSG layer 7, and the layer 9 is then doped to reduce its sheet resistance. The layer 9 is then shaped (FIGS. 6 and 14) by etching, to form it into a rectangular frame 10 encircling the cathode, and a bond pad region 11 connected to the frame 10 by a strip 12. The frame 10 of the polysilicon layer 9 has an aperture 13 symmetrically disposed around the tip 8 of the cathode 3. Using the frame 10 as a mask, a region 14 of the oxide layer 7 around the cathode body is etched away (FIG. 7) using a hydrofluoric acid dip. At the same time, the oxide layer is removed from over the cathode bond pad region 11.

Figure 8:
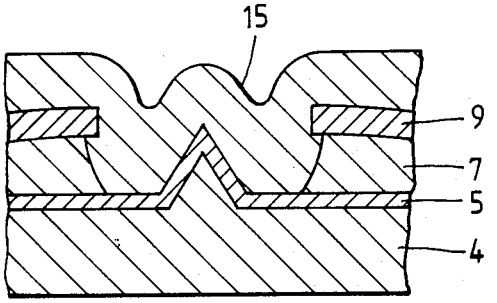

The device is then cleaned and a further composite layer 15 (FIG. 8) of undoped and doped (BPSG) oxide is deposited and planarized. If necessary, the surface may then be smoothed further by controlled etching, as described above.

Figure 9:
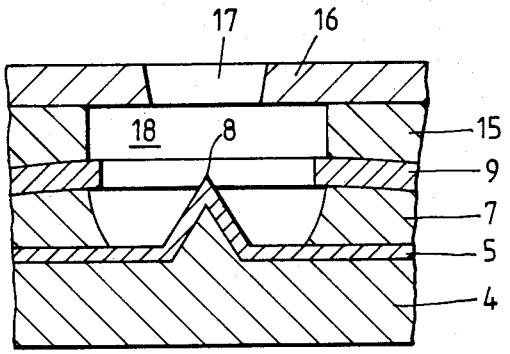

The layer 15 is then masked by a resist layer 16 (FIG. 9) having an aperture 17 therethrough, symmetrically disposed over the tip 8 of the cathode. The aperture 17 is preferably smaller than the aperture 13 in the polysilicon grid layer 9.

Dry and wet etching processes are then used to form a tunnel ("lift shaft") 18 down through the oxide layer 15 to the cathode body 3, and to uncover the edge of the polysilicon grid layer 9 around the cathode tip. At the same time, the oxide layer is removed from over the grid and cathode bond pad regions 6 and 11.

Figure 10:
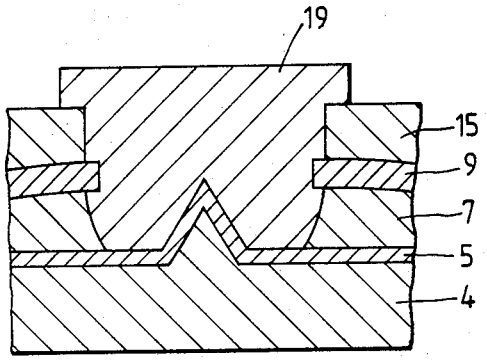

The resist layer 16 is then removed and the device is again cleaned. A thick layer of a resist or of photosensitive polyimide is deposited over the surface. Optimization of the resist coating technique, the choice of resist material, i.e. its solids content and its viscosity, and control of the baking procedure, will result in a planarized layer. A number of coatings may be required in order to improve the surface planarity and to achieve the required spacing between the grid layer 9 and the subsequently-formed anode. A mask is then used to lithographically define a circular plug 19 of the resist filling the interior of the tunnel 18 (FIG. 10). The diameter of the portion of the plug above the oxide layer 15 is larger than the diameter of the aperture in that layer.

Figure 11:
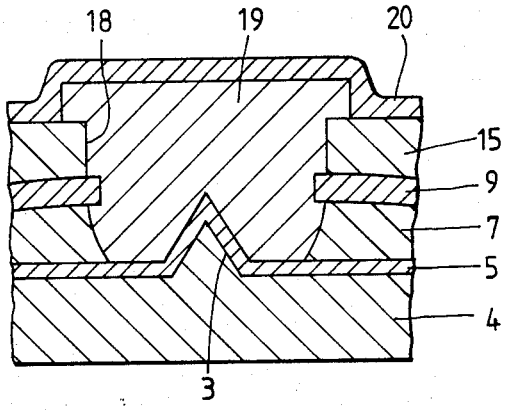
Figure 12:
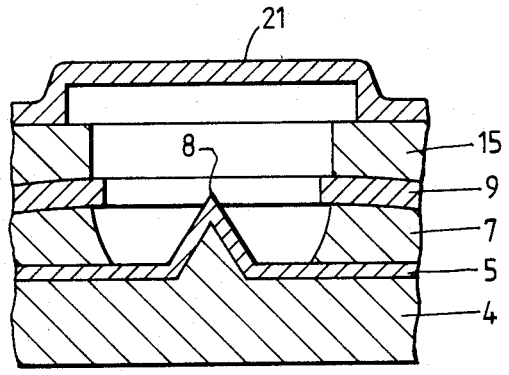
Figure 15:
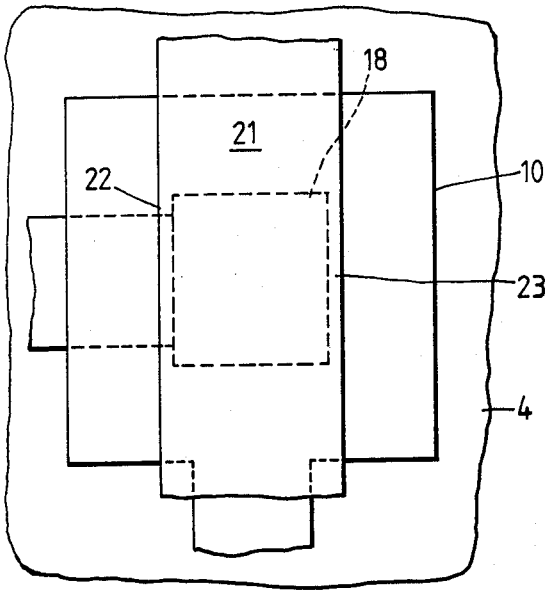

A layer of metal 20 (FIG. 11) of, say, 1 μm thickness is then deposited, by evaporation or sputtering, over the layer 15 and over the plug 19. Lithographic masking of the required anode area is followed by dry etching to define an anode strip 21 (FIGS. 12 and 15). The width of the strip is such that the plug is exposed at opposite edges 22, 23 of the strip. During the operation, metallic bonding pads are formed over the bond pad regions 6 and 11.

The remaining resist material is then removed from over the layer 15, and the resist plug 18 is removed from beneath the anode, via the gaps at the edges 22 and 23, by soaking the device in fuming nitric acid. This results in the anode strip 21 bridging the tunnel 18 as shown in FIG. 12. The strip 21 is self-supporting. The unsupported span of the anode strip may be, say, 0.4–5 μm. The wall of the tunnel 18 and the associated layers are then cleaned, using $O_2$ ashing or ultraviolet-generated ozone, to remove any organic residues therefrom.

The device thus formed is a vertically-configured triode, with the anode spaced from the grid and the cathode, and with an open passage therebetween. It will be apparent, however, that the grid layer 9 and the insulating layer 15 could be omitted, so that a diode structure is formed. It would, alternatively, be possible to deposit one or more additional insulating layers and electrode layers before depositing the anode, to provide a multi-grid structure as will be described later.

As the tunnel 18 in the above-described device is not sealed (due to the apertures at the edges 22 and 23 of the anode strip 21), the device requires an auxiliary evacuated environment for its operation. The need for such environment can be eliminated by closing those gaps. This may be achieved by depositing a further layer 24 of metal, for example, aluminium, (FIG. 16) over the anode and the underlying insulating layer 15, in a vacuum environment. That layer would then be shaped, by masking and etching, to redefine the anode and to isolate the bond pads from each other and from the anode.

Although in the above-described embodiments only a single set of cathode, grid and anode structures is provided, it would clearly be possible to form many of such sets of structures simultaneously on a single substrate. Such sets could readily be connected in parallel, in order to achieve a desired current rating, by merely leaving the metallization 5, the grid layer 9 and the anode layer 20 continuous over the whole area of the device. Alternatively, those layers could be segmented, to provide many separate diodes or triodes, which could be integrated by interconnection as in conventional integrated circuits, thereby allowing the fabrication of a wide variety of circuits. Furthermore, the ability to seal off the tunnel, complete with it own vacuum environment, affords the possibility of easily integrating such devices with conventional integrated circuits without the need for any additional vacuum enclosure.

Although the above embodiment makes use of a silicon substrate, with its well characterized etching properties, to construct the cathode body, any metallic or doped semiconducting material which can be etched to give a cone-shaped cathode body could be used. In particular, a silicon on sapphire substrate or a single crystal tungsten substrate could be used, to allow similar etching of the cathode body. A potential advantage here is that isolation of individual devices is achieved through the insulating sapphire substrate.

The above embodiment provides one or more devices, each of which comprises a single cathode body associated with a single grid electrode and an anode. However, a device might alternatively comprise a plurality of cathode bodies associated with a single grid electrode and a single anode, or alternatively a plurality of cathode bodies, a plurality of grid electrodes, one for each cathode body or group of cathode bodies, and a single anode associated with all of the cathode bodies.

The above description relates to field-induced emission devices wherein the device is contained in an evacuated enclosure or wherein the tunnel 18 is evacuated and is sealed by the layer 24 to avoid the need for such enclosure. Alternatively, the device could operate in a gas-filled enclosure or the tunnel 18 could be gas-filled and then sealed. The initial emission would then still be field-induced, but this would give rise to a gas discharge within the device. Again, a number of grid layers and associated insulating layers could be provided, and in the case of gas-filled devices the above-mentioned staggering of the successive grid apertures to reduce ion bombardment could become more important.

Figure 17:
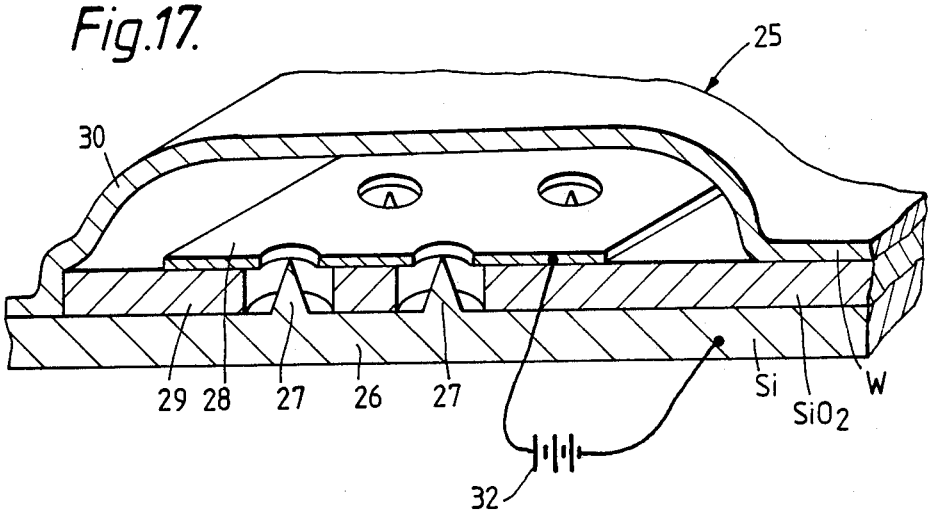
FIG. 17 is a schematic partly cut away cross section through a number of field-emission devices in accordance with the invention forming a switching device.

Referring to FIG. 17, a switching device 25 incorporates a number of vacuum or gas-filled devices as described above, in effect incorporated in a transmission line structure. In this case a substrate 26 is provided with one or more rows of cathode bodies 27. A strip grid line 28 is insulated from the cathode bodies by an apertured insulating layer 29, and an elongate anode layer 30, formed, for example, of tungsten, is spaced from the grid line by depositing a support layer on the grid line, depositing the anode layer on the support layer, and then dissolving the support layer. In a gas-filled device an insulating layer may be provided beneath the anode, which layer may be selectively formed to confine the gas discharge away from the tips of the cathode bodies.

There are two alternative ways of forming the switching device. Either the anode layer 30 can be connected to the cathode structure 26,27, as shown at the left hand side of the figure, to form an untriggered switch, or the anode layer can be insulated from the cathode structure by the insulating layer 29, as shown at the right hand side, to form a triggered switch.

In the case of the triggered switch configuration, a signal to be switched is connected between the anode and the cathode. A voltage is applied between the grid layer 28 and the cathode structure 26,27 from a source 32 to initiate field emission from the cathode to the grid, and the signal path is closed by the resulting current flow. The effective impedance of the transmission line can be made to approximate to 50 Ω by designing the size of the anode/grid gap (i.e. the thickness of the layer 31) and the width of the grid line to be approximately equal.

In the case of the untriggered switch, the anode and cathode structures are interconnected to form, in effect, an outer sheath around a central grid line. In this case, the widths of the anode, cathode and grid structures, and the anode/grid and grid/cathode spacings, are preferably all made comparable to each other to provide an approximately 50 Ω impedance. The untriggered switch relies on the signal, applied between the grid electrode and the combined outer anode-cathode structure, being of sufficient magnitude to initiate field emission between the cathode bodies 27 and the grid electrode.

Figure 18:
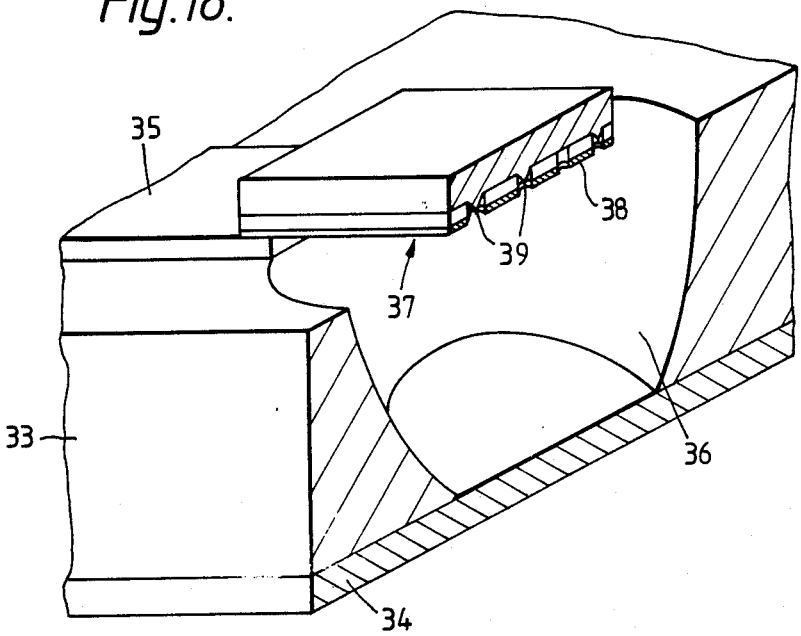
FIG. 18 is a schematic cross section through an alternative form of switching device.

Another triggered switch configuration, which could have a higher current handling capacity than the above-described switches, is shown schematically in FIG. 18. In this case, an insulating support layer 33 has an anode layer 34 deposited on one of its major surfaces. A conductive line 35 is formed on the opposite surface of the support layer 33. A pit 36 is then formed through the layer 33 by a laser or by etching or other erosion process, down to the anode layer 34.

A cathode/grid structure 37, similar to that described above, is then inverted so that its cathode bodies 39 point towards the anode layer, and its grid layer 38 is bonded to the line 35. The anode layer 34 and the grid layer 38 constitute a groundplane and a track, respectively, of a microstrip transmission line. Field-induced electron emission from the cathode bodies 39 is controlled by the cathode-grid voltage. Electrons emitted into the pit 36 provide a low impedance signal path between the grid and anode layers.

Figure 16:
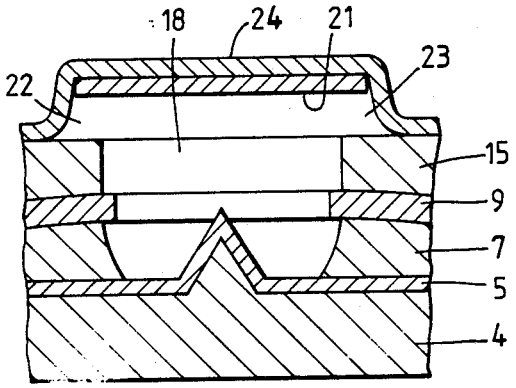
FIG. 16 is a schematic cross section through an alternative form of device in accordance with the invention.
Figure 19:
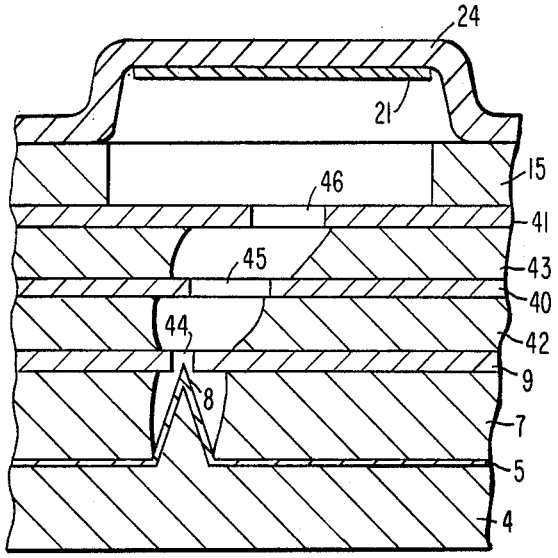
FIG. 19 is a schematic cross section through a device in accordance with the invention having a multi-grid structure with staggered apertures in successive layers.

FIG. 19 is a schematic cross section through a multi-grid structure which is constructed in a similar manner to the structure of FIG. 16, but has two additional grids 40 and 41, with additional insulating layers 42 and 43. In this embodiment the apertures 44,45 and 46 through the electrode layers 9, 40 and 41, respectively, are staggered relative to one another so that there is substantially no direct line-of-sight path between the cathode tip 8 and the anode 21. This helps to prevent ion bombardment of the cathode.

We claim:

1. A method of forming a field-induced emission device, comprising the steps of: forming a cathode body on a substrate; forming thereover an electrically-insulating layer having an aperture therein through which said cathode body is revealed; filling said aperture with a plug of soluble material, said plug having a width; forming a strip of electrically-conductive material on said insulating layer and extending across said plug, said strip having a width that is less than the width of said plug; and dissolving said plug from beneath said conductive strip through at least one gap formed between an edge of said strip and said insulating layer to leave a portion of said strip suspended across said aperture and spaced from said cathode body, to act as an anode.

2. A method as claimed in claim 1, wherein said cathode body is formed by selectively etching away part of the thickness of said substrate.

3. A method as claimed in claim 1, wherein said cathode body tapers in a direction away from said substrate.

4. A method as claimed in claim 3, wherein at least one metallic layer is deposited over said cathode body before deposition of said insulating layer.

5. A method as claimed in claim 1, wherein said plug is formed of a resist material.

6. A method as claimed in claim 1, wherein an electrically-conductive layer is formed between said substrate and said conductive strip and insulated therefrom to act as a control electrode.

7. A method as claimed in claim 6, wherein said conductive layer is provided with an aperture therethrough, substantially in alignment with said aperture in said insulating layer, whereby an edge of said conductive layer around its aperture acts as said control electrode.

8. A method as claimed in claim 7, wherein a plurality of said electrically-conductive layers are provided before said conductive strip is formed, each conductive layer forming a separate control electrode.

9. A method as claimed in claim 8, wherein the apertures through said electrically-conductive layers overlap each other but are mutually staggered so that there is no direct line-of-sight path between said anode and said cathode body.

10. A method as claimed in claim 6, wherein said conductive layer is formed of polysilicon.

11. A method as claimed in claim 10, wherein after deposition of the polysilicon layer, doping of the polysilicon is effected.

12. A method as claimed in claim 8, wherein each said conductive layer is formed of polysilicon.

13. A method as claimed in claim 1, wherein, after removal of said dissolved plug material, the aperture vacated by said plug is evacuated or gas-filled, and the or each gap is sealed by an additional layer formed thereover to retain the vacuum or gas.

14. A field-induced emission device, comprising: a substrate; a cathode body formed on said substrate; a first electrically-insulating layer deposited over said substrate; a plurality of spaced-apart electrically-conductive layers disposed in a stack over said first insulating layer to act respectively as control electrodes; a second electrically-insulating layer deposited on said stack; and a strip of electrically-conductive material supported by said second insulating layer to act as an anode; said insulating layers and the layers of said stack having apertures therethrough through which electrons can flow from said cathode body to said anode, the apertures in successive layers of said stack being offset relative to each other to avoid a direct line-of-sight path between said anode and said cathode body.

15. A device as claimed in claim 14, wherein said cathode body tapers in a direction away from said substrate.

16. A device as claimed in claim 14, wherein said aperture is evacuated or gas-filled and the vacuum or gas is sealed therein.

17. A switching device, comprising a substrate; a plurality of cathode bodies formed on said substrate; an electrically-insulating layer deposited over said substrate and having a plurality of apertures therethrough through which said cathode bodies are revealed; a strip of electrically-conductive material supported by said insulating layer to act as a control electrode and having apertures therein corresponding to said apertures in said insulating layer; and a layer of electrically-conductive material spaced from the control electrode to act as an anode; wherein said substrate, said control electrode and said anode are so dimensioned and spaced as to form at least a section of a transmission line; and wherein said cathode bodies are structured for field-induced electron emission therefrom at a cathode-control electrode voltage less than will cause breakdown of said insulating layer.

18. A device as claimed in claim 17, wherein said anode and said cathode bodies are electrically interconnected, whereby said switching device is rendered conductive by a signal which is to be switched and which is applied between said control electrode and said interconnected anode and cathode bodies.

19. A switching device as claimed in claim 17, including a second insulating layer which is apertured such that a plurality of said cathode bodies are associated with the aperture, whereby the aperture provides an emission path from the associated plurality of cathode bodies to said anode.

* * * * *